United States Patent [19]

Younts et al.

[11] Patent Number: 4,955,412

[45] Date of Patent: Sep. 11, 1990

[54] APPARATUS FOR INJECTING CONFETTI INTO A BALLOON

[75] Inventors: Donna Younts; Eileen Yeung, both of Hong Kong, Hong Kong

[73] Assignee: Continental American Corporation, Wichita, Kans.

[21] Appl. No.: 330,109

[22] Filed: Mar. 29, 1989

[51] Int. Cl.[5] ..... B65B 3/16

[52] U.S. Cl. ..... 141/114; 141/67; 141/313; 141/314; 141/10; 531/556; 531/570; 531/385; 531/390; 222/631; 446/220

[58] Field of Search ..... 141/67, 68, 114, 27, 141/100, 102, 105, 313–315, 10; 446/220, 221, 222, 224, 475, 180, 181, 186, 187; 222/631 X, 632; 239/320, 321, 329; 53/556, 570, 385, 390

[56] References Cited

U.S. PATENT DOCUMENTS

| | | | |
|---|---|---|---|
| 990,228 | 4/1911 | Cohns | 446/475 |
| 1,153,207 | 9/1915 | Eisenberg | 446/475 |
| 1,491,809 | 4/1924 | Macchia | 446/204 |
| 1,560,326 | 11/1925 | Rutherford | 446/475 |
| 1,864,505 | 6/1932 | McCormick | 222/631 |
| 2,701,672 | 2/1955 | Glasco | 141/313 |
| 3,380,490 | 4/1968 | Ellenberg et al. | 141/314 |
| 3,731,421 | 5/1973 | Frattolillo et al. | 446/178 |
| 4,149,338 | 4/1979 | Wolf | 446/186 |
| 4,698,983 | 10/1987 | Hechavarria | 141/67 |
| 4,809,483 | 3/1989 | Lovick | 53/385 |
| 4,878,335 | 11/1989 | Hardy | 53/390 |

FOREIGN PATENT DOCUMENTS

| | | | |
|---|---|---|---|
| 609837 | 10/1948 | United Kingdom | 239/320 |

*Primary Examiner*—Henry J. Recla
*Assistant Examiner*—Edward C. Donovan
*Attorney, Agent, or Firm*—Herbert J. Hammond

[57] ABSTRACT

The present invention relates to an apparatus for simultaneously injecting confetti and air into a balloon by utilizing an air pump in conjunction with a separate container for storing confetti and guiding the air flow provided by the air pump. As the pump is operated, the air flow from the attached container mixes with the confetti and the air-confetti mixture injected into a balloon attached to the container. The present invention also relates to an apparatus for simultaneously injecting confetti and gas into a balloon by utilizing a standard flex-tip balloon inflation regulator in connection with the confetti container and a gas cylinder.

10 Claims, 4 Drawing Sheets

APPARATUS FOR INJECTING CONFETTI INTO A BALLOON

TECHNICAL FIELD

This invention relates to the injection of confetti into a balloon and in particular, relates to an apparatus for simultaneously injecting confetti and air into a balloon.

BACKGROUND

Confetti and balloons are employed at festive occasions such as holidays, birthdays, anniversaries, weddings, and other joyous events throughout the year.

In the past, balloons used at these social gatherings have been inflated by lung power, air pumps and gas cylinders such as a helium tank. At these gala occasions confetti has been scattered by hand or through the employment of various toy guns such as those disclosed in U.S. Pat. Nos. 990,228, 1,153,207, 1,591,809, 1,560,326 and 3,731,421. Such prior art devices do not, however, facilitate the use of confetti in balloons.

At many such social events, it is highly desirable to have the confetti actually inside balloons for decorative purposes and to facilitate the scattering of confetti upon bursting of the balloons. Prior to the present invention, confetti was placed inside balloons either by opening the neck of the balloon and placing the confetti inside by hand or by utilizing a funnel for adding the confetti. At social events requiring many balloons, this is a very time consuming and messy project.

On the other hand, the present apparatus provides a quick, easy, and inexpensive solution to the above problem by allowing one to simultaneously inject confetti and air or gas into a balloon. By utilizing an air pump or gas cylinder connected to a container for storing confetti, the present apparatus is able to simultaneously inject confetti and air or gas into a balloon.

Additionally, the confetti container is large enough so as to allow several balloons to be inflated and injected with confetti before it is necessary to refill the container. Thus, the present invention provides numerous advantages over the prior art.

SUMMARY OF THE INVENTION

The present invention relates to an apparatus for simultaneously injecting air or gas and confetti into a balloon. In its preferred embodiment, the apparatus comprises an air pump for providing a flow of air; a container connected to the air pump for storing confetti and guiding the air flow; means for securing the container to the air pump and means for attaching a balloon to the container.

As the air pump is operated, it provides a flow of air through the confetti container forcing a mixture of the confetti and air out through a nozzle projection portion of the container and into a balloon.

Once the balloon is adequately filled with confetti and air, it is removed, tied and the next balloon positioned for repeating the above operation.

The confetti container may also be utilized in connection with a conventional gas cylinder, such as a helium tank, featuring a conventional flex tip balloon inflation regulator. In such cases, the balloon is attached to the container and the container is connected to the cylinder regulator inflating tip. The balloon is then filled with a mixture of confetti and gas.

BRIEF DESCRIPTION OF THE DRAWINGS

A more complete understanding of the invention may be had by reference to the following Detailed Description when taken in conjunction with the accompanying Drawings, in which.

DETAILED DESCRIPTION OF THE INVENTION

Figure 1:
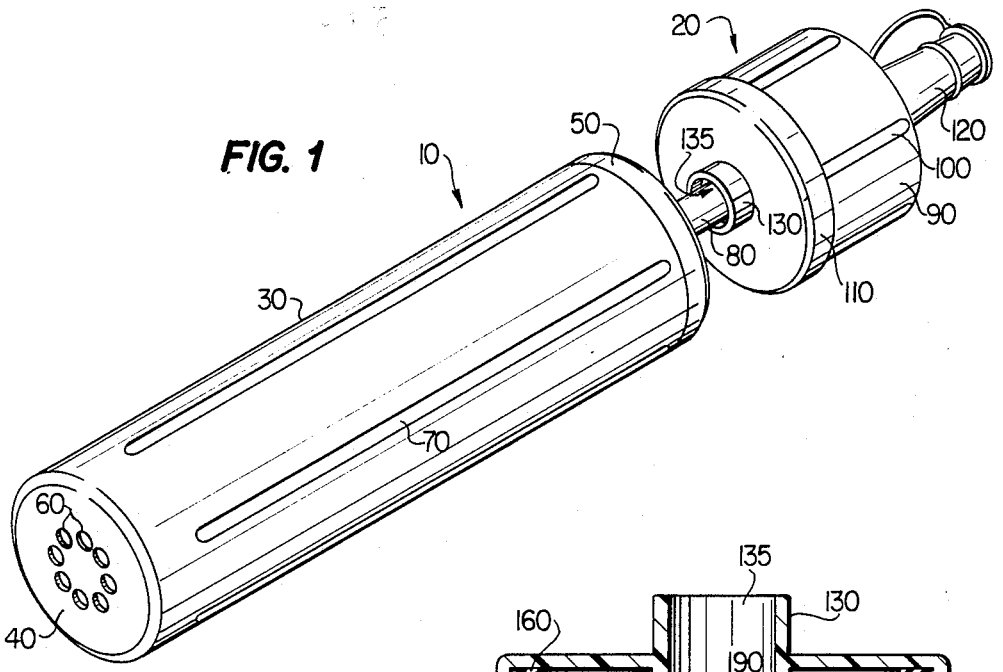
FIG. 1 is a side view of one embodiment of the invention disclosing an air pump connected to the confetti container.

FIG. 1, a longitudinal side view of one embodiment of the present invention, shows an air pump 10 connected to the confetti container 20. The air pump 10 may be of any conventional type as long as it is capable of connection to the confetti container 20 and provides an air flow. In one embodiment, however, the air pump 10 is a hand-held and hand operated air pump having a hollow cylindrical body portion 30, a bottom end 40 and top end 50. The bottom end 40 and the top end 50 both have a plurality of circular openings 60 which allow the flow of air therethrough.

The body portion 30 of the air pump 10, in one embodiment, has a plurality of longitudinal ridges 70 along its exterior surface for allowing the operator to obtain a better grip upon the air pump 10. In FIG. 1 the air pump 10 is connected to the confetti container 20 via an elongated piston rod 80 connected to a centrally located conventional internal piston (not shown).

The confetti container 20, disclosed in FIG. 1, also has a body portion 90, a bottom cap 110 and an upper nozzle projection 120. The body portion 90 in the disclosed embodiment has a plurality of longitudinal ridges 100 along its exterior surface that allow the user to obtain a better grip upon the container 20. The bottom cap 110 in FIG. 1 has an outer circular extension 130 with a central opening 135 into which the elongated piston rod 80 of the air pump 10 is inserted for connection with the container 20.

Although the air pump 10 provides an air flow for inflating the balloon and injecting confetti, it should be understood that other conventional air pumps that expel air during the inflating process and that are capable of connection to the confetti container 20 may be utilized. Indeed, in a second embodiment of the present invention, the container 20 is connected to a gas cylinder 25 having a conventional flex-tip balloon inflation regulator 35 capable of inflating balloons (shown in FIG. 8).

Figure 2:
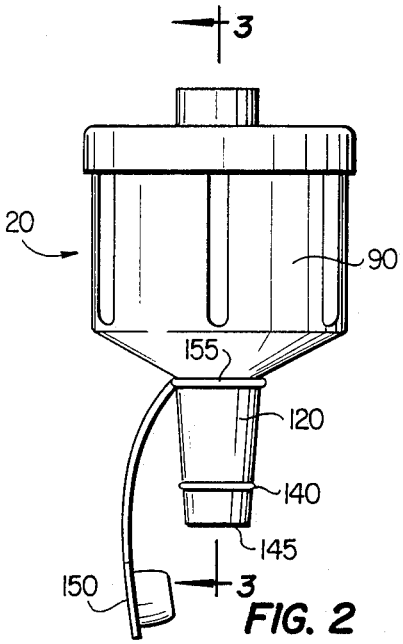
FIG. 2 is a side view of the confetti container.

Turning to FIG. 2 therein is illustrated that the upper nozzle projection 120 of the container 20 also has a circular projecting ridge 140 located approximately one fourth (¼) of the way down from the nozzle projection opening 145. The ridge 140 assists in engaging the neck of a balloon 225 (shown in FIG. 9) for attachment of the balloon to the confetti container 20.

A rubber stopper 150 is attached to the base end of the nozzle projection 120 by means of a circular ring 155. The circular ring 155 prevents the loss of the stopper 150 when in the opened position.

Figure 3:
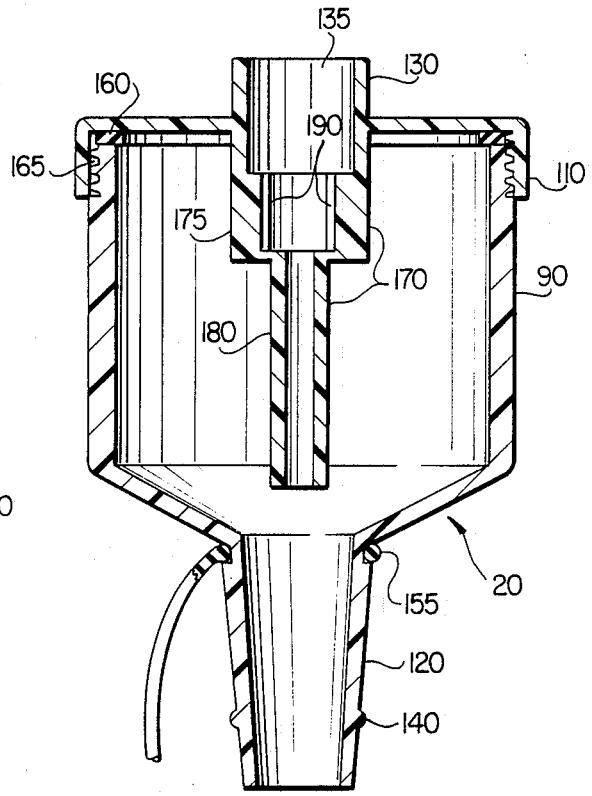
FIG. 3 is a cross-sectional view of the confetti container taken along the lines 3—3 of FIG. 2 disclosing the interior of the confetti container.

Referring to FIG. 3, a cross-sectional view of the confetti container 20 along the lines 3—3 of FIG. 2, therein is further disclosed a plurality of threads 160 along the body portion 90 of the confetti container 20 that match the threads 165 on the bottom cap 110. The matching threads 160 and 165 are used to screw the bottom cap 110 onto and off of the confetti container 20. The bottom cap 110 is removed from the confetti container 20 when confetti is placed into the container 20.

Although the bottom cap 110 is connected to the body portion 90 of the container 20 via the threads 160 and 165, other conventional fastening mechanism may be utilized as long as the bottom cap 110 is capable of being removed and replaced.

The bottom cap 110 of FIG. 3 also has a centrally located cylindrical interior projection 170 that is contiguous with the outer circular extension 130. The cylindrical interior projection 170 has a short, thick portion 175 and a longer narrow portion 180. The interior projection 170 guides the air flow from the air pump 10 and forces the air to circulate through the confetti container 20 providing rapid mixing of the confetti with the air for injection of the confetti and air into a balloon. The short, thick portion 175 of the interior projection 170 has a pair of matching notches 190 which help to connect the air pump 10 to the confetti container 20.

Figure 4:
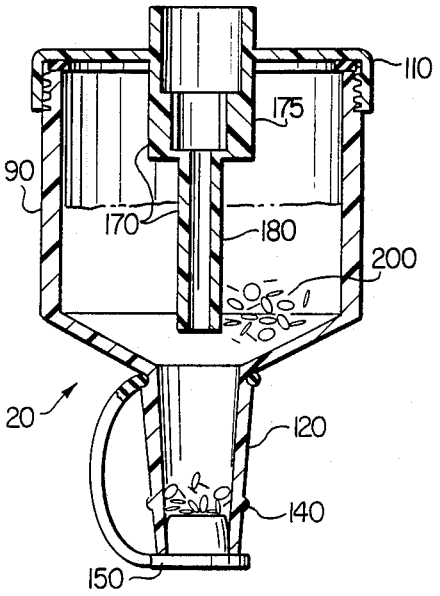
FIG. 4 is a cross-sectional view of the confetti container of FIG. 3 further disclosing the stored confetti.

FIG. 4 discloses the addition of confetti 200 to the container 20. In FIG. 4 the rubber stopper 150 is inserted in the opening 145 thereby preventing the loss of confetti 200 through the opening 145. FIG. 4 also discloses that the narrow portion 180 of the interior projection 170 extends into the confetti 200 which aids in the mixing process.

Figure 5:
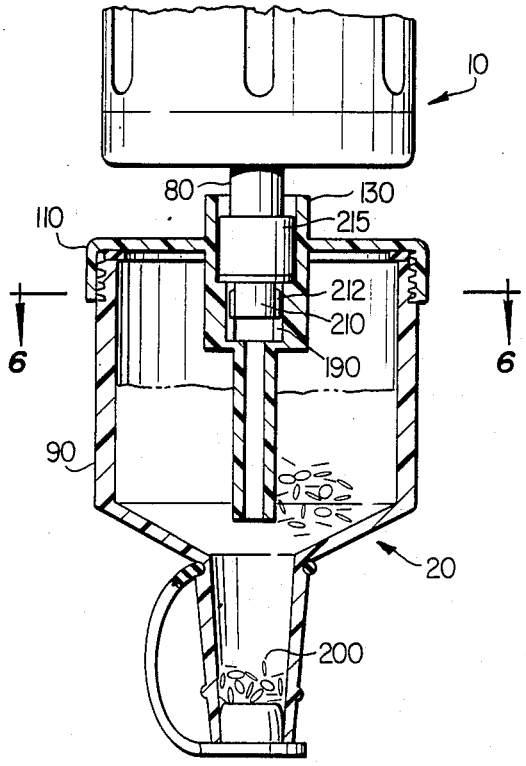
FIG. 5 is a cross-sectional view of the confetti container shown in FIG. 4 further disclosing its connection to an air pump shown in part.

In FIG. 5 the air pump 10 is connected to the confetti container 20. FIG. 5 illustrates that a small diameter circular tip 210 and a large diameter circular tip 215 are on the end of the elongated piston rod 80 not connected to the piston. The tips 210 and 215 are utilized to secure the air pump 10 to the confetti container 20.

The small diameter circular tip 210 has a pair of splines 212 that match the pair of notches 190 in the thick portion 175 of the interior projection 170 of the bottom cap 110. The larger diameter circular tip 215 frictionally engages the circular extension 130 of the bottom cap 110.

In order to secure the air pump 10 with the confetti container 20, after the splines 212 are aligned with the matching notches 190, the piston rod 80 is given a turn, normally clockwise, engaging the notches 190 with the unnotched portion of the interior of the thick portion 175 of the interior projection 170. When it is time to remove the air pump 10, for the addition of confetti or after the completion of the task, the piston rod 80 is turned in the opposite direction, normally counterclockwise, until the splines 212 align with the notches 190 for removal of the air pump 10. The locking mechanism is better disclosed in FIGS. 6 and 7.

Figure 6:
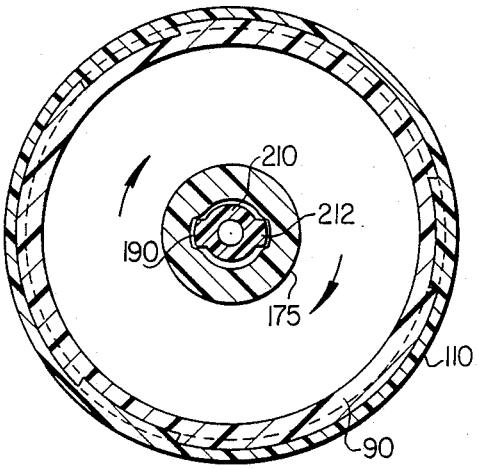
FIG. 6 is a cross-sectional view of the confetti container and its connection to an air pump looking down along the lines 6—6 of FIG. 5.

FIG. 6, a cross-sectional view along the lines 6—6 of FIG. 5, discloses the insertion of the small diameter circular tip 210 and splines 212 into the thick portion 175 of the interior projection 170. The splines 212 must be aligned with the notches 190 when the piston rod 80 is first inserted into the confetti container 20 for proper connection.

Figure 7:
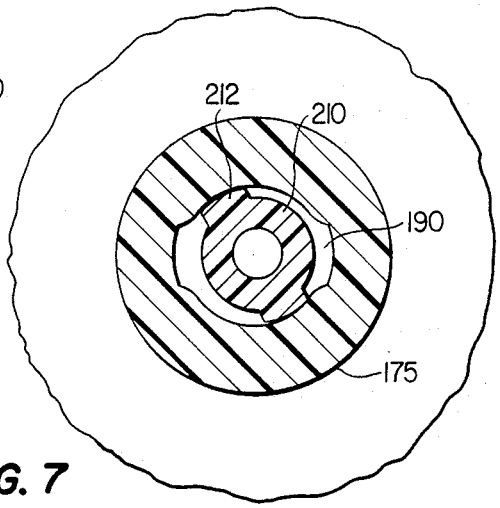
FIG. 7 is a partial cross-sectional view of the connection between the air pump and confetti container shown in FIG. 6 further illustrating the connection.

In FIG. 7 the splines 212 of the small diameter circular tip 210 are engaged with the unnotched sides of the thick portion 175 of the interior projection 170. When so engaged, the air pump 10 is securely mated with the container 20. In order to remove the air pump 10 from the container 20, the small diameter circular tip 210 is rotated until the splines 212 match up with the notches 190 of the thick portion 175.

Figure 8:
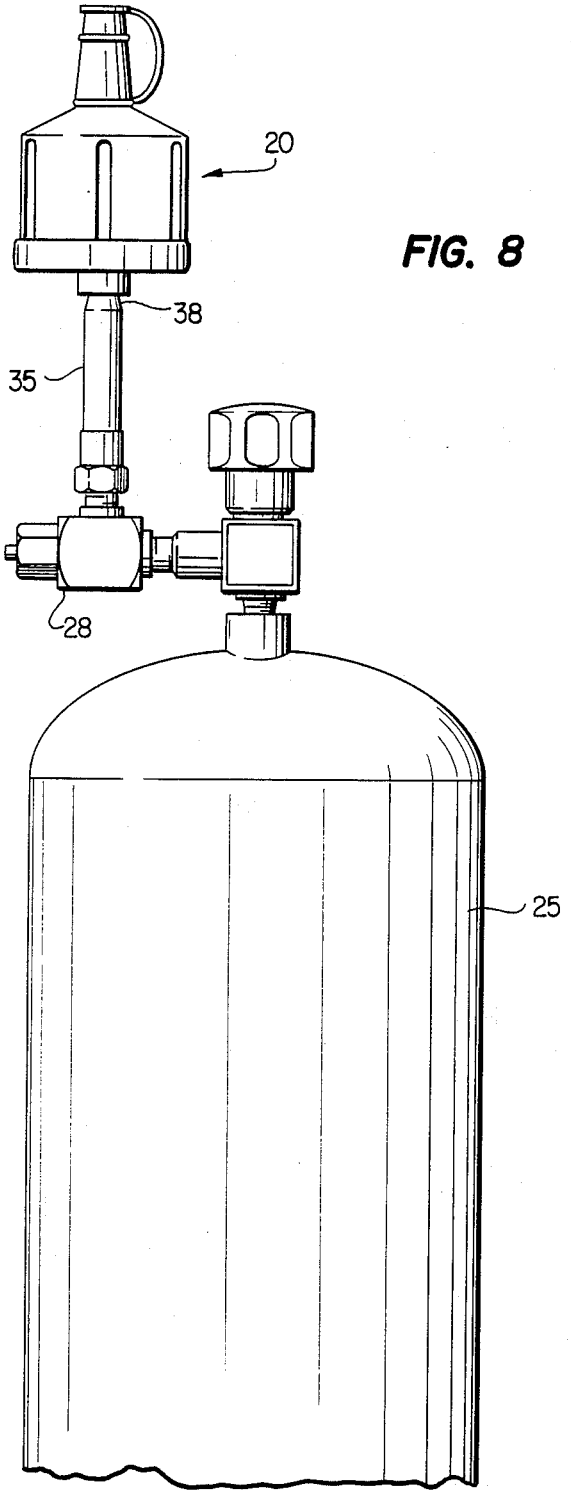
FIG. 8 is a perspective view of the confetti container and its connection to a flex-tip balloon inflation regulator and gas cylinder.

FIG. 8 illustrates that the present invention encompasses a second embodiment in which gas and confetti are simultaneously injected into a balloon. In this embodiment, the confetti container 20 is attached to the rubber tip portion 38 of a flex tip balloon inflation regulator 35 connected to the regulator 28 of a gas cylinder 25.

Figure 9:
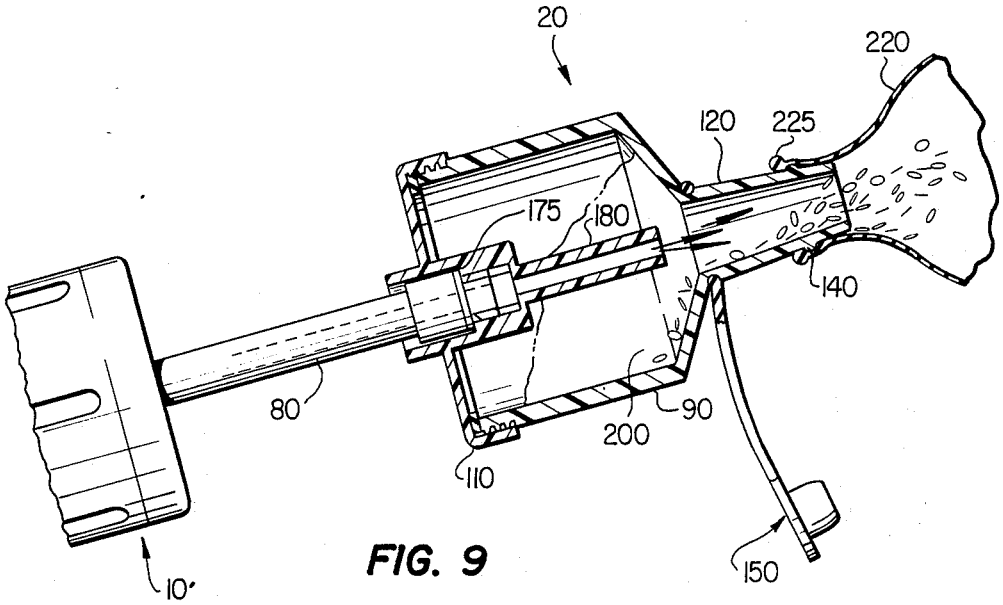
FIG. 9 is a longitudinal cross-sectional view of the confetti container and its connection to an air pump and a balloon further disclosing the injection of confetti and air into the balloon.

FIG. 9 illustrates the air pump 10 in operation injecting confetti 200 into a balloon 220. As the air pump 10 is vigorously pumped, air flows through the elongated piston rod 80 and through the narrow portion 180 of the interior projection 170 of the bottom cap 110. As the air exits the narrow portion 180, it forces an air and confetti 200 mixture into the balloon 220 attached to the upper nozzle projection 120 of the container 20 by means of the balloon neck's 225 engagement with the ridge 140 surrounding the nozzle projection 120. Of course the rubber stopper 150 must be removed from the nozzle projection 120 when filling the balloon with air and confetti.

To operate the present invention apparatus, the stopper 150 is first placed into the nozzle projection 120 of the confetti container 20. Subsequently the bottom cap 110 is twisted, normally counterclockwise, and removed. The confetti container 20 is then filled with confetti 200, normally of one-fourth (¼) inch or less in diameter, until it is almost full. At this time the bottom cap 110 is replaced by twisting it in the opposite direction, normally clockwise, until it is snug.

The confetti container 20 is then attached to the air pump 10 by extending the elongated piston rod 80 and grasping it in one hand. The bottom cap 110 of the container 20 is then placed on the elongated piston rod 80 and the splines 212 are lined up with the notches 190 until the container 20 gently falls into place.

The confetti container 20 is then turned, normally clockwise, to lock it in place. At this time, the stopper 150 is removed and a balloon 220 is slipped over the ridge 140 of the nozzle projection 120 until the balloon neck 225 is approximately one-half (½) inch below the ridge 140. Afterwards the air pump 10 is held with one hand and the confetti container 20 in the other with the balloon neck 225 being held in place with the thumb and index finger. Vigorous pumping of the air pump 10 results in the simultaneous injection of air and confetti into the balloon.

For the maximum injection of confetti the container 20 and air pump 10 should be tilted downward while inflating. The further down it is tilted, the more confetti will enter the balloon. The balloon 220 is then removed from the confetti container 20 after inflating by rolling the balloon neck 225 up and off of the nozzle projection 120. After the balloon is tied, the apparatus is then ready to inflate and inject confetti into the next balloon.

In another embodiment, the present invention is utilized with a conventional gas cylinder 25 such as, for example, a helium tank featuring a conventional flex-tip balloon inflation regulator 35 (shown in FIG. 8). The same steps of filling the confetti container 20 with confetti 200 are followed as described above. Subsequently the balloon 220 is placed over the nozzle projection 120.

At this time the container 20 and attached balloon 220 are secured onto the tip portion 38 of the regulator 35 and held with one hand. While holding the balloon neck 225 in place with the thumb and index finger, the cylinder's full force is turned on to inject confetti and gas. Afterwards the balloon is removed as before by rolling the balloon neck 225 up and off.

Finally, it is to be understood that the present invention may also be utilized to spray confetti into the air without the use of a balloon. All of the previous steps may be utilized with the exception that no balloon is attached. A vigorous pumping action will spray confetti into the air.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

We claim:

1. An apparatus for simultaneously injecting confetti and air into a balloon comprising:

an air pump for providing a flow of air;

a container for storing confetti;

inlet means on said container for securing the container to the air pump for receiving the flow of air therefrom outlet means on said container for attaching a balloon to the container; and said container including air flow guide means for guiding a mixture of air and confetti into said balloon.

2. An apparatus for simultaneously injecting confetti and air into a balloon in accordance with claim 1 wherein the air pump further comprises:

a hand operated cylindrical air pump having a bottom end and a top end with each end having a plurality of circular openings and a centrally located piston having an elongated piston rod attached thereto for providing a flow of air on both the upstroke and downstroke.

3. An apparatus for simultaneously injecting confetti and air into a balloon in accordance with claim 1 wherein the container further comprises:

a removable bottom cap; a body portion; and said airflow guide means includes a nozzle projection for guiding air and confetti into a balloon.

4. An apparatus for simultaneously injecting confetti and air into a balloon in accordance with claim 1 wherein the means for securing the container to the air pump further comprises:

an elongated piston rod connected to the air pump and extending therethrough with a circular tip having a pair of exterior splines;

a removable bottom cap attached to the container having a pair of notches in a thick portion of an interior projection thereof; and wherein the exterior splines of the piston rod are inserted into the notches of the bottom cap for securing the air pump to the container when twisted.

5. An apparatus for simultaneously injecting confetti and air into a balloon in accordance with claim 1 wherein the means for attaching a balloon to the container further comprises:

a circular external ridge on a nozzle projection of the container for assisting engagement with a balloon neck.

6. An apparatus for simultaneously injecting confetti and air into a balloon comprising:

a hand operated cylindrical air pump having bottom and top ends with each end having a plurality of circular openings;

a piston centrally located in the air pump having a hollow elongated piston rod attached thereto for providing a flow of air when the air pump is operated;

a container connected to the elongated piston rod, said container having a removable bottom cap, a body portion for storing confetti, and a nozzle projection for guiding a mixture of air and confetti into a balloon when the air pump is operated and means for attaching a balloon to the container.

7. An apparatus for simultaneously injecting confetti and air into a balloon comprising:

a hand operated cylindrical air pump having a bottom end and a top end with each end having a plurality of circular openings and a centrally located piston having an elongated piston rod attached thereto for providing a flow of air on both the upstroke and downstroke:

a container having a removable bottom cap, a body portion for storing confetti and a nozzle projection for guiding air and confetti into a balloon;

means for securing the container to the air pump; and means for attaching a balloon to the container.

8. An apparatus for simultaneously injecting confetti and air into a balloon in accordance with claim 7 wherein the means for securing the container to the air pump further comprises:

an elongated piston rod connected to the air pump and extending therethrough with a circular tip having a pair of exterior splines;

a removable bottom cap attached to the container having a pair of notches in a thick portion of an interior projection thereof; and wherein the exterior splines of the piston rod are inserted into the notches of the bottom cap for securing the air pump to the container when twisted.

9. An apparatus for simultaneously injecting confetti and air into a balloon in accordance with claim 7 wherein the means for securing the container to the air pump further comprises:

a circular external ridge on a nozzle projection of the container for assisting engagement with a balloon neck.

10. An apparatus for simultaneously injecting confetti and and air into a balloon comprising:

a hand operated cylindrical air pump having a bottom end and a top end with each end having a plurality of circular openings and a centrally located piston having an elongated piston rod extending therethrough with a circular tip having a pair of exterior splines for providing a flow of air on both the upstroke and downstroke;

a container having a removable bottom cap having a pair of notches in a thick portion of an interior projection thereof, a body portion for storing confetti, and a nozzle projection having a circular exterior ridge for engagement with a balloon neck for guiding air and confetti into a balloon; and wherein the exterior splines of the piston rod are inserted into the notches of the bottom cap for securing the air pump to the container when twisted.

* * * * *